US009624643B2

(12) United States Patent
Hendron et al.

(10) Patent No.: US 9,624,643 B2
(45) Date of Patent: Apr. 18, 2017

(54) BLADE TILT SYSTEM AND METHOD FOR A WORK VEHICLE

(71) Applicant: Deere & Company, Moline, IL (US)

(72) Inventors: Scott S. Hendron, Dubuque, IA (US); Brian C. Proeber, Dubuque, IA (US); Bryan Rausch, Durango, IA (US); Travis Wiens, Saskatoon (CA); Jeff Dobchuk, Saskatoon (CA); George W. Bozdech, Dubuque, IA (US)

(73) Assignee: Deere & Company, Moline, IL (US)

( * ) Notice: Subject to any disclaimer, the term of this patent is extended or adjusted under 35 U.S.C. 154(b) by 91 days.

(21) Appl. No.: 14/614,560

(22) Filed: Feb. 5, 2015

(65) Prior Publication Data

US 2016/0230367 A1 Aug. 11, 2016

(51) Int. Cl.

| | |
|---|---|
| ***E02F 3/84*** | (2006.01) |
| ***E02F 3/76*** | (2006.01) |
| ***E02F 9/26*** | (2006.01) |

(52) U.S. Cl.

CPC ..... *E02F 3/847* (2013.01); *E02F 3/7627* (2013.01); *E02F 3/7631* (2013.01); *E02F 3/845* (2013.01); *E02F 9/262* (2013.01)

(58) Field of Classification Search

CPC ..... E02F 3/7613; E02F 3/844; E02F 3/845; E02F 3/847

USPC ..... 172/4, 4.5, 779, 821, 822, 823

See application file for complete search history.

(56) References Cited

U.S. PATENT DOCUMENTS

| | | | | |
|---|---|---|---|---|
| 2,941,319 | A | 6/1960 | Beemer et al. | |
| 4,535,847 | A | 8/1985 | Hasegawa et al. | |
| 5,462,125 | A | 10/1995 | Stratton et al. | |
| 5,487,428 | A * | 1/1996 | Yamamoto | E02F 3/845 172/4.5 |
| 5,499,684 | A | 3/1996 | Stratton | |
| 5,551,518 | A | 9/1996 | Stratton | |
| 5,862,868 | A | 1/1999 | Yamamoto et al. | |
| 5,987,371 | A | 11/1999 | Bailey et al. | |
| 6,035,241 | A | 3/2000 | Yamamoto | |

(Continued)

FOREIGN PATENT DOCUMENTS

EP 1118719 A2 7/2001

OTHER PUBLICATIONS

Earthmoving Report: Cat K2 Dozers Offer Finely Tuned Finish Grading. Earthmoving Report [online]. Feb. 28, 2012. [retrieved on May 19, 2014] http://www.constructionequipment.com/earthmoving-report-cat-K2-dozers-offer-finely-tuned-finish-grading.

(Continued)

*Primary Examiner* — Gary Hartmann

(57) ABSTRACT

A work vehicle may comprise a chassis, a ground-engaging blade, a sensor assembly, and a controller. The ground-engaging blade may be movably connected to the chassis via a linkage configured to allow the blade to be tilted relative to the chassis. The sensor assembly may be connected to the work vehicle and configured to provide a tilt signal indicative of an angle of the blade in a roll direction and a roll signal indicative of a rotational velocity of the blade in the roll direction. The controller may be configured to determine a target tilt angle, receive the tilt signal, receive the roll signal, and send a command to tilt the blade toward the target tilt angle, the command based on the tilt signal, the roll signal, and the target tilt angle.

5 Claims, 5 Drawing Sheets

(56) References Cited

U.S. PATENT DOCUMENTS

| | | | | |
|---|---|---|---|---|
| 6,112,145 | A | 8/2000 | Zachman | |
| 6,164,117 | A | 12/2000 | Passwater et al. | |
| 6,269,885 | B1 | 8/2001 | Barber et al. | |
| 6,609,315 | B1 | 8/2003 | Hendron et al. | |
| 6,655,465 | B2 * | 12/2003 | Carlson | E02F 3/847 172/4.5 |
| 6,757,994 | B1 | 7/2004 | Hendron | |
| 6,763,619 | B2 | 7/2004 | Hendron et al. | |
| 7,121,355 | B2 | 10/2006 | Lumpkins et al. | |
| 7,206,681 | B2 | 4/2007 | Casey et al. | |
| 7,317,977 | B2 | 1/2008 | Matrosov | |
| 7,588,088 | B2 | 9/2009 | Zachman | |
| 7,643,923 | B2 | 1/2010 | Buehlmann et al. | |
| 8,060,299 | B2 | 11/2011 | Gharsalli et al. | |
| 8,082,084 | B2 | 12/2011 | Nichols | |
| 8,141,650 | B2 | 3/2012 | Breiner et al. | |
| 8,145,391 | B2 | 3/2012 | Omelchenko et al. | |
| 8,275,524 | B2 | 9/2012 | Krause et al. | |
| 8,340,873 | B2 | 12/2012 | Finley et al. | |
| 8,352,132 | B2 | 1/2013 | Omelchenko et al. | |
| 8,360,165 | B2 * | 1/2013 | Leith | A01B 59/06 172/821 |
| 8,406,963 | B2 | 3/2013 | Farmer et al. | |
| 8,412,418 | B2 | 4/2013 | Kumagai et al. | |
| 8,473,166 | B2 | 6/2013 | Zhdanov et al. | |
| 8,594,879 | B2 | 11/2013 | Roberge et al. | |
| 8,634,991 | B2 | 1/2014 | Douglas | |
| 8,655,556 | B2 * | 2/2014 | Hayashi | E02F 3/847 172/12 |
| 8,731,784 | B2 * | 5/2014 | Hayashi | E02F 3/7618 172/701.1 |
| 8,738,242 | B2 * | 5/2014 | Konno | E02F 3/845 172/25 |
| 8,919,455 | B2 | 12/2014 | Hendron et al. | |
| 9,043,097 | B2 * | 5/2015 | Fehr | E02F 3/845 701/50 |
| 9,200,426 | B2 * | 12/2015 | Hayashi | E02F 3/7618 |
| 9,328,479 | B1 * | 5/2016 | Rausch | E02F 3/845 |
| 9,481,983 | B2 * | 11/2016 | Taylor | E02F 3/842 |
| 9,551,130 | B2 * | 1/2017 | Hendron | E02F 3/844 |
| 2008/0087447 | A1 | 4/2008 | Piekutowski | |
| 2008/0127530 | A1 | 6/2008 | Kelly | |
| 2009/0112410 | A1 | 4/2009 | Shull | |
| 2011/0153170 | A1 | 6/2011 | Dishman et al. | |
| 2011/0169949 | A1 | 7/2011 | McCain et al. | |
| 2011/0213529 | A1 | 9/2011 | Krause et al. | |
| 2012/0059554 | A1 | 3/2012 | Omelchenko et al. | |
| 2013/0080112 | A1 | 3/2013 | Friend | |
| 2013/0158818 | A1 | 6/2013 | Callaway | |
| 2013/0158819 | A1 * | 6/2013 | Callaway | E02F 3/845 701/50 |
| 2014/0019013 | A1 | 1/2014 | Liu et al. | |

OTHER PUBLICATIONS

Cat |New Cat® D6K2 Track—Type Tractor Offers Refined Blade Control and Enhanced . . . [online]. Apr. 2014. [retrieved on May 19, 2014] http://www.cat.com/en GB/news/press-release/new-cat-d6k2-tracktypetractorolfersrefine.

Cat |New Cat® D6K2 Track—Type Tractor Offers Refined Blade Control and Enhanced . . . [online]. Apr. 2014. [retrieved on May 19, 2014] http://www.cat.com/en GB/news/press-release/new-cat-d6k2-tracktypetractoroffersrefine.

* cited by examiner

BLADE TILT SYSTEM AND METHOD FOR A WORK VEHICLE

FIELD OF THE DISCLOSURE

The present disclosure relates to machine. An embodiment of the present disclosure relates to a system and method for tilting a ground-engaging blade of a work vehicle.

BACKGROUND

Work vehicles with ground-engaging blades may be used to shape and smooth ground surfaces. Such work vehicles may be supported by wheels or tracks which may encounter raised and lowered features on the ground as the work vehicle moves, which may cause the work vehicle to tilt left or tilt right if the feature is encountered differently by the left and right sides of the work vehicle. This tilting of the work vehicle may be transmitted to the ground-engaging blade, causing it to tilt left and right relative to the ground and create unintended variations on the ground surface. This effect may be amplified for those work vehicles with a ground engaging blade in front of the work vehicles' tires or tracks, as the work vehicle may create new and larger unintended variations as it passes over the unintended variations just created by the ground-engaging blade due to earlier tilting left and right. If this self-reinforcing effect goes uncorrected by an operator, it may create a "washboard" or "wavy" type surface on the ground or other unintended surface pattern.

SUMMARY

According to an aspect of the present disclosure, a work vehicle may include a chassis, a ground-engaging blade, a sensor assembly, and a controller. The ground-engaging blade may be movably connected to the chassis via a linkage configured to allow the blade to be tilted relative to the chassis. The sensor assembly may be connected to the work vehicle, configured to provide a tilt signal indicative of an angle of the blade in a roll direction, and configured to provide a roll signal indicative of a rotational velocity of the blade in the roll direction. The controller may be configured to determine a target tilt angle, receive the tilt signal, receive the roll signal, and send a command to tilt the blade toward the target tilt angle, the command based on the tilt signal, the roll signal, and the target tilt angle.

According to another aspect of the present disclosure, the sensor assembly may be connected to the blade at a fixed relative position to the blade and the tilt signal is indicative of an angle of the blade relative to the direction of gravity.

According to another aspect of the present disclosure, the sensor assembly may be a first sensor assembly and the work vehicle may further include a second sensor assembly. The second sensor assembly may be connected to the chassis at a fixed relative position to the chassis. The second sensor assembly may be configured to provide a chassis roll signal indicative of a rotational velocity of the chassis in the roll direction. The command may be based on the tilt signal, the roll signal, the target tilt angle, and the chassis roll signal.

According to another aspect of the present disclosure, the controller may be further configured to receive a tilt command from an operator input and determine the target tilt angle based on the tilt signal after the most recent tilt command.

According to another aspect of the present disclosure, the controller may be further configured to determine the target tilt angle based on a signal from a satellite-based navigation system or a local positioning system.

According to another aspect of the present disclosure, the controller may be further configured to determine the command signal based on a first gain applied to a difference between the tilt signal and the target tilt angle and a second gain applied to the roll signal.

According to another aspect of the present disclosure, the work vehicle may further include a means for communicating a difference between the tilt signal and the target tilt angle to an operator.

According to another aspect of the present disclosure, a method of controlling a work vehicle with a ground-engaging blade may include determining a target tilt angle, receiving a tilt signal indicative of a tilt angle of the work vehicle in the roll direction, receiving a roll signal indicative of a rotational velocity of the work vehicle in a roll direction, and determining a command signal to tilt the blade toward the target tilt angle based on the tilt signal, the roll signal, and the target tilt angle.

According to another aspect of the present disclosure, the tilt signal may be a blade tilt signal indicative of a tilt angle of the blade relative to the direction of gravity, the roll signal may be a blade roll signal indicative of a rotational velocity of the blade in the roll direction, and the method may further include receiving a chassis roll signal indicative of a rotational velocity of a chassis of the work vehicle in the roll direction, where the command signal is determined based on the blade tilt signal, the blade roll signal, and the chassis roll signal.

According to another aspect of the present disclosure, the method may further include receiving a chassis tilt signal indicative of a tilt angle of the chassis relative to the direction of gravity, where the command signal is determined based on the blade tilt signal, the blade roll signal, the chassis tilt signal, and the chassis roll signal.

According to another aspect of the present disclosure, the target tilt angle may be determined based on the tilt signal after an operator's most recent tilt command.

According to another aspect of the present disclosure, the target tilt angle may be determined based on a signal from a satellite-based navigation system or a local positioning system.

According to another aspect of the present disclosure, the command signal may be determined based on a first gain applied to a difference between the tilt signal and the target tilt angle and a second gain applied to the roll signal.

According to another aspect of the present disclosure, the tilt signal and the roll signal may be provided by a sensor assembly comprising at least one accelerometer and at least one gyroscope, where the tilt signal is based on a signal from the at least one accelerometer and the roll signal is based on a signal from the at least one gyroscope.

According to another aspect of the present disclosure, a crawler-dozer may include a chassis, a ground-engaging blade, a hydraulic cylinder, an electrohydraulic valve assembly, a sensor assembly, and a controller. The ground-engaging blade may be movably connected to the chassis via a linkage configured to allow the blade to be tilted. The hydraulic cylinder may be connected to the linkage and configured to tilt the blade. The electrohydraulic valve assembly may be hydraulically connected to the hydraulic cylinder and configured to actuate the hydraulic cylinder. The sensor assembly may be connected to the blade at a fixed relative position to the blade and configured to provide a blade tilt signal indicative of a tilt angle of the blade relative to the direction of gravity and a blade roll signal indicative of a rotational velocity of the blade in a roll direction. The controller may be in communication with the sensor assembly and the electrohydraulic valve assembly and configured to determine a target tilt angle, receive the blade tilt signal, receive the blade roll signal, determine a command signal to tilt the blade toward the target tilt angle based on the blade tilt signal, the blade roll signal, and the target tilt angle, and send the command signal to the electrohydraulic valve assembly.

According to another aspect of the present disclosure, the sensor assembly may be a first sensor assembly and the crawler-dozer may further include a second sensor assembly. The second sensor assembly may be connected to the chassis at a fixed relative position to the chassis. The second sensor assembly may be configured to provide a chassis roll signal indicative of a rotational velocity of the chassis in the roll direction. The controller may be further configured to determine the command signal based on the blade tilt signal, the blade roll signal, and the chassis roll signal to tilt the blade toward the target tilt angle.

According to another aspect of the present disclosure, the controller may be further configured to receive a tilt command from an operator input and determine the target tilt angle based on the blade tilt signal after the most recent tilt command.

According to another aspect of the present disclosure, the controller may be further configured to determine the target tilt angle based on a signal from a satellite-based navigation system or a local positioning system.

According to another aspect of the present disclosure, the controller may be further configured to determine the command signal based on a first gain applied to a difference between the blade tilt signal and the target tilt angle and a second gain applied to the blade roll signal.

According to another aspect of the present disclosure, the sensor assembly may be comprised of at least one gyroscope and at least one accelerometer.

The above and other features will become apparent from the following description and accompanying drawings.

BRIEF DESCRIPTION OF THE DRAWINGS

The detailed description of the drawings refers to the accompanying figures in which.

Like reference numerals are used to indicate like elements throughout the several figures.

DETAILED DESCRIPTION

Figure 1:
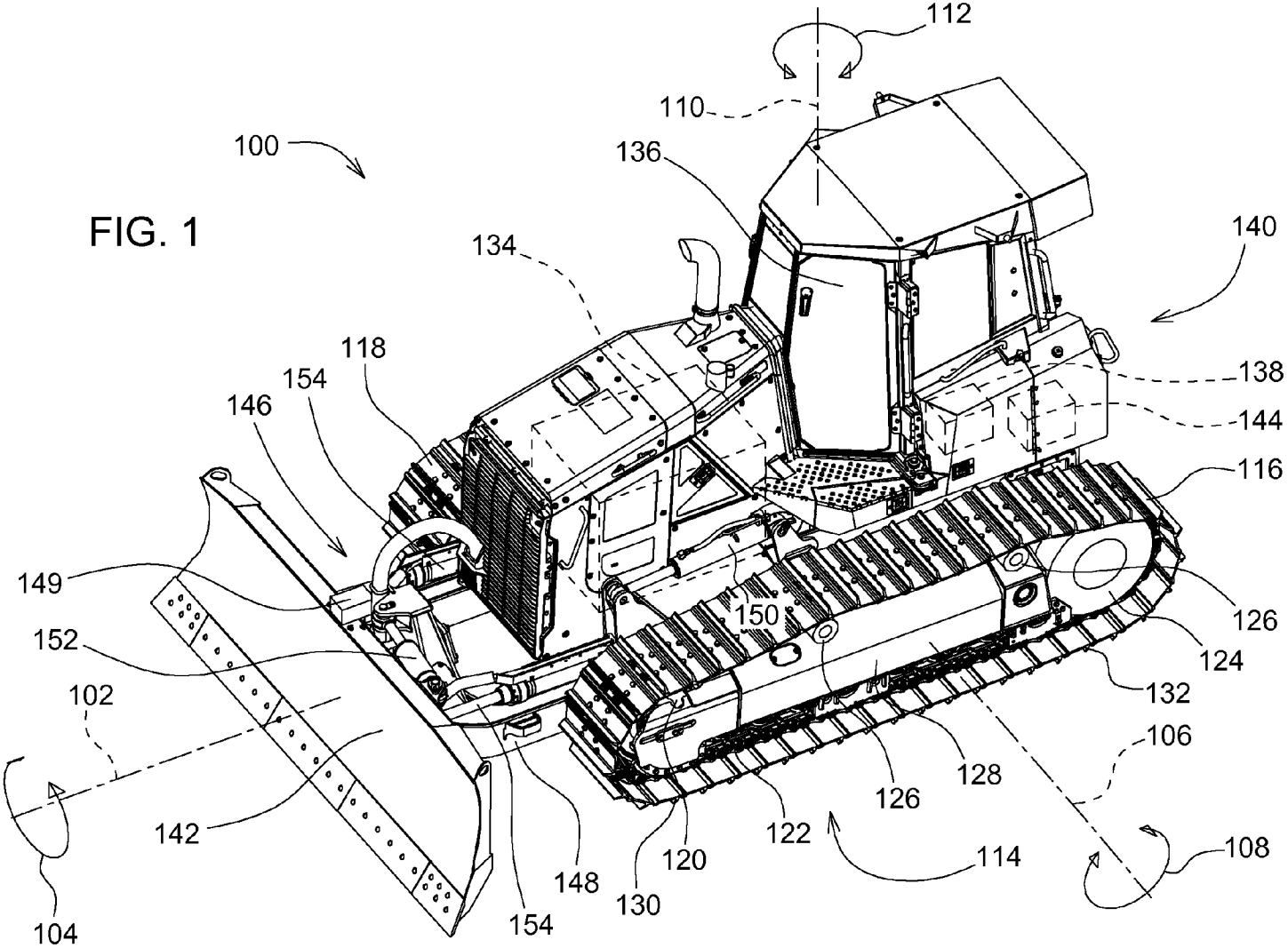
FIG. 1 is a perspective work of a work vehicle, for example a crawler dozer.

FIG. 1 is a perspective view of work vehicle 100. Work vehicle 100 is illustrated as a crawler dozer, which may also be referred to as a crawler, but may be any work vehicle with a ground-engaging blade or work implement such as a compact track loader, motor grader, scraper, skid steer, and tractor, to name a few examples. Work vehicle 100 may be operated to engage the ground and cut and move material to achieve simple or complex features on the ground. As used herein, directions with regard to work vehicle 100 may be referred to from the perspective of an operator seated within operator station 136: the left of work vehicle 100 is to the left of such an operator, the right of work vehicle 100 is to the right of such an operator, the front or fore of work vehicle 100 is the direction such an operator faces, the rear or aft of work vehicle 100 is behind such an operator, the top of work vehicle 100 is above such an operator, and the bottom of work vehicle 100 is below such an operator. While operating, work vehicle 100 may experience movement in three directions and rotation in three directions. Direction for work vehicle 100 may also be referred to with regard to longitude 102 or the longitudinal direction, latitude 106 or the lateral direction, and vertical 110 or the vertical direction. Rotation for work vehicle 100 may be referred to as roll 104 or the roll direction, pitch 108 or the pitch direction, and yaw 112 or the yaw direction or heading.

Work vehicle 100 is supported on the ground by undercarriage 114. Undercarriage 114 includes left track 116 and right track 118, which engage the ground and provide tractive force for work vehicle 100. Left track 116 and right track 118 may be comprised of shoes with grousers that sink into the ground to increase traction, and interconnecting components that allow the tracks to rotate about front idlers 120, track rollers 122, rear sprockets 124 and top idlers 126. Such interconnecting components may include links, pins, bushings, and guides, to name a few components. Front idlers 120, track rollers 122, and rear sprockets 124, on both the left and right sides of work vehicle 100, provide support for work vehicle 100 on the ground. Front idlers 120, track rollers 122, rear sprockets 124, and top idlers 126 are all pivotally connected to the remainder of work vehicle 100 and rotationally coupled to their respective tracks so as to rotate with those tracks. Track frame 128 provides structural support or strength to these components and the remainder of undercarriage 114.

Front idlers 120 are positioned at the longitudinal front of left track 116 and right track 118 and provide a rotating surface for the tracks to rotate about and a support point to transfer force between work vehicle 100 and the ground. Left track 116 and right track 118 rotate about front idlers 120 as they transition between their vertically lower and vertically upper portions parallel to the ground, so approximately half of the outer diameter of each of front idlers 120 is engaged with left track 116 or right track 118. This engagement may be through a sprocket and pin arrangement, where pins included in left track 116 and right track 118 are engaged by recesses in front idler 120 so as to transfer force. This engagement also results in the vertical height of left track 116 and right track 118 being only slightly larger than the outer diameter of each of front idlers 120 at the longitudinal front of left track 116 and right track 118. Frontmost engaging point 130 of left track 116 and right track 118 can be approximated as the point on each track vertically below the center of front idlers 120, which is the frontmost point of left track 116 and right track 118 which engages the ground. When work vehicle 100 encounters a ground feature when traveling in a forward direction, left track 116 and right track 118 may first encounter it at frontmost engaging point 130. If the ground feature is at a higher elevation than the surrounding ground surface (i.e., an upward ground feature), work vehicle 100 may begin pitching backward (which may also be referred to as pitching upward) when frontmost engaging point 130 reaches the ground feature. If the ground feature is at a lower elevation than the surrounding ground surface (i.e., a downward ground feature), work vehicle 100 may continue forward without pitching until the center of gravity of work vehicle 100 is vertically above the edge of the downward ground feature. At that point, work vehicle 100 may pitch forward (which may also be referred to as pitching downward) until frontmost engaging point 130 contacts the ground. In this embodiment, front idlers 120 are not powered and thus are freely driven by left track 116 and right track 118. In alternative embodiments, front idlers 120 may be powered, such as by an electric or hydraulic motor, or may have an included braking mechanism configured to resist rotation and thereby slow left track 116 and right track 118.

Track rollers 122 are longitudinally positioned between front idler 120 and rear sprocket 124 along the bottom left and bottom right sides of work vehicle 100. Each of track rollers 122 may be rotationally coupled to left track 116 or right track 118 through engagement between an upper surface of the tracks and a lower surface of track rollers 122. This configuration may allow track rollers 122 to provide support to work vehicle 100, and in particular may allow for the transfer of forces in the vertical direction between work vehicle 100 and the ground. This configuration also resists the upward deflection of left track 116 and right track 118 as they traverse an upward ground feature whose longitudinal length is less than the distance between front idler 120 and rear sprocket 124.

Rear sprockets 124 may be positioned at the longitudinal rear of left track 116 and right track 118 and, similar to front idlers 120, provide a rotating surface for the tracks to rotate about and a support point to transfer force between work vehicle 100 and the ground. Left track 116 and right track 118 rotate about rear sprockets 124 as they transition between their vertically lower and vertically upper portions parallel to the ground, so approximately half of the outer diameter of each of rear sprockets 124 is engaged with left track 116 or right track 118. This engagement may be through a sprocket and pin arrangement, where pins included in left track 116 and right track 118 are engaged by recesses in rear sprockets 124 so as to transfer force. This engagement also results in the vertical height of left track 116 and right track 118 being only slightly larger than the outer diameter of each of rear sprockets 124 at the longitudinal back or rear of left track 116 and right track 118. Rearmost engaging point 132 of left track 116 and right track 118 can be approximated as the point on each track vertically below the center of rear sprockets 124, which is the rearmost point of left track 116 and right track 118 which engages the ground. When work vehicle 100 encounters a ground feature when traveling in a reverse or backward direction, left track 116 and right track 118 may first encounter it at rearmost engaging point 132. If the ground feature is at a higher elevation than the surrounding ground surface, work vehicle 100 may begin pitching forward when rearmost engaging point 132 reaches the ground feature. If the ground feature is at a lower elevation than the surrounding ground surface, work vehicle 100 may continue backward without pitching until the center of gravity of work vehicle 100 is vertically above the edge of the downward ground feature. At that point, work vehicle 100 may pitch backward until rearmost engaging point 132 contacts the ground.

In this embodiment, each of rear sprockets 124 may be powered by a rotationally coupled hydraulic motor so as drive left track 116 and right track 118 and thereby control propulsion and traction for work vehicle 100. Each of the left and right hydraulic motors may receive pressurized hydraulic fluid from a hydrostatic pump whose direction of flow and displacement controls the direction of rotation and speed of rotation for the left and right hydraulic motors. Each hydrostatic pump may be driven by engine 134 of work vehicle 100, and may be controlled by an operator in operator station 136 issuing commands which may be received by controller 138 and communicated to the left and right hydrostatic pumps by controller 138. In alternative embodiments, each of rear sprockets 124 may be driven by a rotationally coupled electric motor or a mechanical system transmitting power from engine 134.

Top idlers 126 are longitudinally positioned between front idlers 120 and rear sprockets 124 along the left and right sides of work vehicle 100 above track rollers 122. Similar to track rollers 122, each of top idlers 126 may be rotationally coupled to left track 116 or right track 118 through engagement between a lower surface of the tracks and an upper surface of top idlers 126. This configuration may allow top idlers 126 to support left track 116 and right track 118 for the longitudinal span between front idler 120 and rear sprocket 124, and prevent downward deflection of the upper portion of left track 116 and right track 118 parallel to the ground between front idler 120 and rear sprocket 124.

Undercarriage 114 is affixed to, and provides support and tractive effort for, chassis 140 of work vehicle 100. Chassis 140 is the frame which provides structural support and rigidity to work vehicle 100, allowing for the transfer of force between blade 142 and left track 116 and right track 118. In this embodiment, chassis 140 is a weldment comprised of multiple formed and joined steel members, but in alternative embodiments it may be comprised of any number of different materials or configurations. Sensor 144 is affixed to chassis 140 of work vehicle 100 and configured to provide a signal indicative of the movement and orientation of chassis 140. In alternative embodiments, sensor 144 may not be affixed directly to chassis 140, but may instead be connected to chassis 140 through intermediate components or structures, such as rubberized mounts. Connecting sensor 144 to chassis 140 in a fixed relative position through the use of mounts or brackets may allow sensor 144 to experience and measure the motion of chassis 140, enabling measurements by sensor 144 to be indicative of the similar measurements taken from a sensor directly affixed to chassis 140.

Sensor 144 is an optional component configured to provide a signal indicative of the angle of chassis 140 in the direction of roll 104 and the angular velocity of chassis 140 in the direction of roll 104. These signals may be referred to as a chassis tilt signal and a chassis roll signal, respectively. Sensor 144 may also be configured to provide a signal or signals indicative of other positions or velocities of chassis 140, including its inclination (i.e., an angle of chassis 140 relative to the direction of gravity) in a direction such as the direction of roll 104, pitch 108, and yaw 112, its angular velocity or angular acceleration in a direction such as the direction of roll 104, pitch 108, yaw 112, or its linear velocity or linear acceleration in a direction such as the direction of longitude 102, latitude 106, and vertical 110. Sensor 144 may be configured to directly measure angular acceleration, angular velocity, or angular position, or measure one of these and derive or integrate the measurements to arrive at another of these (e.g., integrate angular velocity to arrive at angular position). The placement of sensor 144 on chassis 140 instead of on blade 142 or linkage 146 may allow sensor 144 to be better protected from damage, more firmly affixed to work vehicle 100, more easily packaged, or more easily integrated into another component of work vehicle 100 such as controller 138. This placement may allow for sensor 144 to be more cost effective, durable, reliable, or accurate than if sensor 144 were placed on blade 142 or linkage 146, even though placing sensor 144 directly on blade 142 or linkage 146 (such as sensor 149) may allow for a more direct reading of a position, velocity, or acceleration of those components.

Blade 142 is a work implement which may engage the ground or material to move or shape it. Blade 142 may be used to move material from one location to another and to create features on the ground, including flat areas, grades, hills, roads, or more complexly shaped features. In this embodiment, blade 142 of work vehicle 100 may be referred to as a six-way blade, six-way adjustable blade, or power-angle-tilt (PAT) blade. Blade 142 may be hydraulically actuated to move vertically up or vertically down (which may also be referred to as blade lift, or raise and lower), roll left or roll right (which may be referred to as blade tilt, or tilt left and tilt right), and yaw left or yaw right (which may be referred to as blade angle, or angle left and angle right). Alternative embodiments may utilize a blade with fewer hydraulically controlled degrees of freedom, such as a 4-way blade that may not be angled, or actuated in the direction of yaw 112.

Blade 142 is movably connected to chassis 140 of work vehicle 100 through linkage 146, which supports and actuates blade 142 and is configured to allow blade 142 to be tilted relative to chassis 140 (i.e., moved in the direction of roll 104). Linkage 146 may include multiple structural members to carry forces between blade 142 and the remainder of work vehicle 100 and may provide attachment points for hydraulic cylinders which may actuate blade 142 in the lift, tilt, and angle directions.

Linkage 146 includes c-frame 148, a structural member with a C-shape positioned rearward of blade 142, with the C-shape open toward the rear of work vehicle 100. Each rearward end of c-frame 148 is pivotally connected to chassis 140 of work vehicle 100, such as through a pin-bushing joint, allowing the front of c-frame 148 to be raised or lowered relative to work vehicle 100 about the pivotal connections at the rear of c-frame 148. The front portion of c-frame 148, which is approximately positioned at the lateral center of work vehicle 100, connects to blade 142 through a ball-socket joint. This allows blade 142 three degrees of freedom in its orientation relative to c-frame 148 (lift-tilt-angle) while still transferring rearward forces on blade 142 to the remainder of work vehicle 100.

Sensor 149 is affixed to blade 142 above the ball-socket joint connecting blade 142 to c-frame 148. Sensor 149, like sensor 144, may be configured to measure orientation, angular velocity, or acceleration. Sensor 149 may be connected to blade 142 through an intermediate component, such as a bracket, mount, or portion of linkage 146, at a fixed relative position to blade 142 so that may experience and measure the motion of blade 142, enabling measurements by sensor 149 to be indicative of similar measurements taken from a sensor directly affixed to blade 142. Sensor 149 may include one more gyroscopes which it may use to sense angular velocities and one or more accelerometers which it may use to measure linear acceleration. Sensor 149 may sense the tilt angle of blade 142 by measuring linear acceleration in three substantially perpendicular axes, and using those measurements to determine the direction of gravity and thereby determine the tilt angle of blade 142. Controller 138 may actuate blade 142 based on the signals it receives from sensor 144 and sensor 149, as further described with regard to FIG. 2, FIG. 3, FIG. 4, and FIG. 5. As used herein, "based on" means "based at least in part on" and does not mean "based solely on," such that it neither excludes nor requires additional factors.

Blade 142 may be raised or lowered relative to work vehicle 100 by the actuation of lift cylinders 150, which may raise and lower c-frame 148 and thus raise and lower blade 142, which may also be referred to as blade lift. For each of lift cylinders 150, the rod end is pivotally connected to an upward projecting clevis of c-frame 148 and the head end is pivotally connected to the remainder of work vehicle 100 just below and forward of operator station 136. The configuration of linkage 146 and the positioning of the pivotal connections for the head end and rod end of lift cylinders 150 results in the extension of lift cylinders 150 lowering blade 142 and the retraction of lift cylinders 150 raising blade 142. In alternative embodiments, blade 142 may be raised or lowered by a different mechanism, or lift cylinders 150 may be configured differently, such as a configuration in which the extension of lift cylinders 150 raises blade 142 and the retraction of lift cylinders 150 lowers blade 142.

Blade 142 may be tilted relative to work vehicle 100 by the actuation of tilt cylinder 152, which may also be referred to as moving blade 142 in the direction of roll 104. For tilt cylinder 152, the rod end is pivotally connected to a clevis positioned on the back and left sides of blade 142 above the ball-socket joint between blade 142 and c-frame 148 and the head end is pivotally connected to an upward projecting portion of linkage 146. The positioning of the pivotal connections for the head end and the rod end of tilt cylinder 152 result in the extension of tilt cylinder 152 tilting blade 142 to the left or counterclockwise when viewed from operator station 136 and the retraction of tilt cylinder 152 tilting blade 142 to the right or clockwise when viewed from operator station 136. In alternative embodiments, blade 142 may be tilted by a different mechanism (e.g., an electrical or hydraulic motor) or tilt cylinder 152 may be configured differently, such as a configuration in which it is mounted vertically and positioned on the left or right side of blade 142, or a configuration with two tilt cylinders.

Blade 142 may be angled relative to work vehicle 100 by the actuation of angle cylinders 154, which may also be referred to as moving blade 142 in the direction of yaw 112. For each of angle cylinders 154, the rod end is pivotally connected to a clevis of blade 142 while the head end is pivotally connected to a clevis of c-frame 148. One of angle cylinders 154 is positioned on the left side of work vehicle 100, left of the ball-socket joint between blade 142 and c-frame 148, and the other of angle cylinders 154 is positioned on the right side of work vehicle 100, right of the ball-socket joint between blade 142 and c-frame 148. This positioning results in the extension of the left of angle cylinders 154 and the retraction of the right of angle cylinders 154 angling blade 142 rightward, or yawing blade 142 clockwise when viewed from above, and the retraction of left of angle cylinder 150 and the extension of the right of angle cylinders 154 angling blade 142 leftward, or yawing blade 142 counterclockwise when viewed from above. In alternative embodiments, blade 142 may be angled by a different mechanism or angle cylinders 154 may be configured differently.

Due to the geometry of linkage 146 and the geometry of the pivotal connections of tilt cylinder 152 in this embodiment, blade 142 is not tilted at a rate that is perfectly proportional to the extension or refraction speed of tilt cylinder 152. This means that the tilt velocity of blade 142 is not perfectly proportional to the linear velocity with which tilt cylinder 152 is extending or retracting, and the tilt velocity of blade 142 may vary even when the linear velocity of tilt cylinder 152 is constant. This also means that tilt cylinder 152 has a mechanical advantage which varies depending on the tilt angle of blade 142. Given a kinematic model of blade 142, linkage 146, and/or tilt cylinder 152 (e.g., formula(s) or table(s) providing a relationship between the position and/or movement of portions of blade 142, linkage 146, and tilt cylinder 152) and the state of blade 142, linkage 146, and/or tilt cylinder 152 (e.g., sensor(s) sensing one or more positions, angles, or orientations of blade 142, linkage 146, and tilt cylinder 152, such as sensor 149), at least with respect to blade tilt, controller 138 may compensate for such non-linearity. Incomplete or simplified kinematic models may be used if there is a need to only focus on particular motion relationships (e.g., only those affecting blade tilt) or if only limited compensation accuracy is desired. Controller 138 may utilize this compensation and a desired velocity, for example a command to tilt blade 142 at a particular tilt velocity, to issue a command that may achieve a flow rate into tilt cylinder 152 that results in blade 142 being tilted at the particular vertical velocity regardless of the current position of blade 142. For example, controller 138 may issue commands which vary the flow rate into tilt cylinder 152 in order to achieve a substantially constant tilt velocity of blade 142.

Similarly, due to the positioning of lift cylinders 150 and angle cylinders 154 and the configuration of their connection to blade 142, the velocity of blade lift and the angular velocity of blade angle are not perfectly proportional to the linear velocity of lift cylinders 150 and angle cylinders 154, respectively, and the velocity of blade lift and the angular velocity of blade angle may vary even when the linear velocity of lift cylinders 150 and angle cylinders 154, respectively, is constant. This also means that lift cylinders 150 and angle cylinders 154 each has a mechanical advantage which varies depending on the position of blade 142. Much like with tilt cylinder 152, given a kinematic model of blade 142 and linkage 146, and the state of blade 142 and linkage 146, at least with respect to blade lift and angle, controller 138 may compensate for such non-linearity. Incomplete or simplified kinematic models may be used if there is a need to only focus on particular motion relationships (e.g., only those affecting blade lift and angle) or if only limited compensation accuracy is required. Controller 138 may utilize this compensation and a desired velocity, for example a command to lift blade 142 at a particular velocity or angle blade 142 at a particular angular velocity, to issue commands that may vary the flow rate into lift cylinders 150 or angle cylinders 154 to result in blade 142 being lifted or angled at the particular velocity or angular velocity regardless of the current position of blade 142 or linkage 146.

In alternative embodiments, blade 142 may be connected to the remainder of work vehicle 100 in a manner which tends to make the blade lift velocity (in direction of vertical 110), tilt angular velocity (in the direction of roll 104), or angle angular velocity (in the direction of yaw 112) proportional to the linear velocity of lift cylinders 150, tilt cylinder 152, or angle cylinders 154, respectively. This may be achieved with particular designs of linkage 146 and positioning of the pivotal connections of lift cylinders 150, tilt cylinder 152, and angle cylinders 154. In such alternative embodiments, controller 138 may not need to compensate for non-linear responses of blade 142 to the actuation of lift cylinders 150, tilt cylinder 152, and angle cylinders 154, or the need for compensation may be reduced.

Each of lift cylinders 150, tilt cylinder 152, and angle cylinders 154 is a double acting hydraulic cylinder. One end of each cylinder may be referred to as a head end, and the end of each cylinder opposite the head end may be referred to as a rod end. Each of the head end and the rod end may be fixedly connected to another component or, as in this embodiment, pivotally connected to another component, such as a through a pin-bushing or pin-bearing coupling, to name but two examples of pivotal connections. As a double acting hydraulic cylinder, each may exert a force in the extending or retracting direction. Directing pressurized hydraulic fluid into a head chamber of the cylinders will tend to exert a force in the extending direction, while directing pressurized hydraulic fluid into a rod chamber of the cylinders will tend to exert a force in the retracting direction. The head chamber and the rod chamber may both be located within a barrel of the hydraulic cylinder, and may both be part of a larger cavity which is separated by a movable piston connected to a rod of the hydraulic cylinder. The volumes of each of the head chamber and the rod chamber change with movement of the piston, while movement of the piston results in extension or retraction of the hydraulic cylinder. The control of these cylinders will be described in further detail with regard to FIG. 2.

Figure 2:
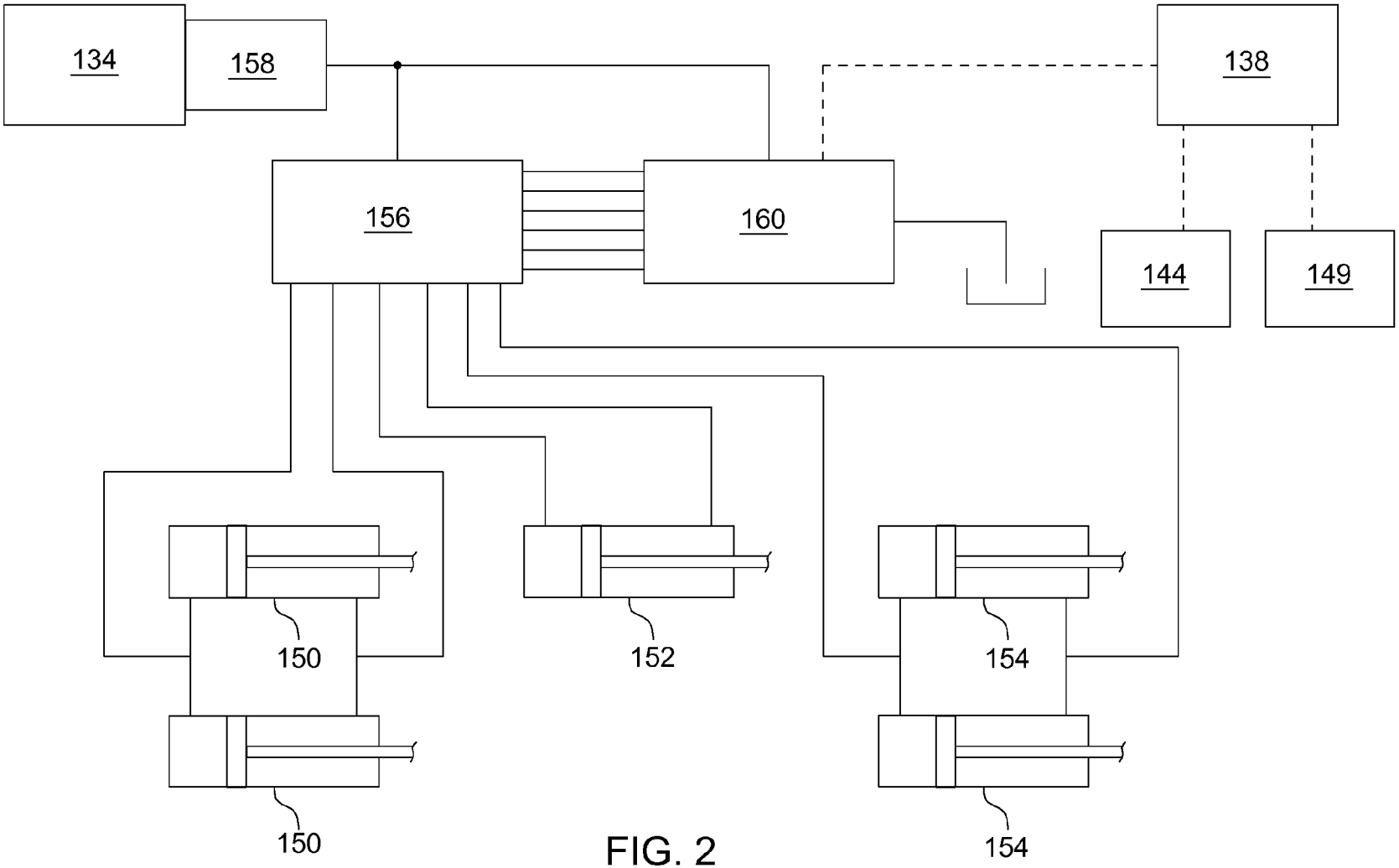
FIG. 2 is a schematic of a portion of the hydraulic and electrical system of the crawler dozer.

FIG. 2 is a schematic of a portion of a system for controlling the hydraulic cylinder, the system including hydraulic and electrical components. Each of lift cylinders 150, tilt cylinder 152, and angle cylinders 154 is hydraulically connected to hydraulic control valve 156, which may be positioned in an interior area of work vehicle 100. Hydraulic control valve 156 may also be referred to as a valve assembly or manifold. Hydraulic control valve 156 receives pressurized hydraulic fluid from hydraulic pump 158, which may be rotationally connected to engine 134, and directs such fluid to lift cylinders 150, tilt cylinder 152, angle cylinders 154, and other hydraulic circuits or functions of work vehicle 100. Hydraulic control valve 156 may meter such fluid out, or control the flow rate of hydraulic fluid to each hydraulic circuit to which it is connected. In alternative embodiments, hydraulic control valve 156 may not meter such fluid out but may instead only selectively provide flow paths to these functions while metering is performed by another component (e.g., a variable displacement hydraulic pump) or not performed at all. Hydraulic control valve 156 may meter such fluid out through a plurality of spools, whose positions control the flow of hydraulic fluid, and other hydraulic logic. The spools may be actuated by solenoids, pilots (e.g., pressurized hydraulic fluid acting on the spool), the pressure upstream or downstream of the spool, or some combination of these and other elements.

In the embodiment illustrated in FIG. 1, the spools of hydraulic control valve 156 are shifted by pilots whose pressure is controlled, at least in part, by electrohydraulic pilot valve 160 in communication with controller 138. Electrohydraulic pilot valve 160 is positioned within an interior area of work vehicle 100 and receives pressurized hydraulic fluid from a hydraulic source and selectively directs such fluid to pilot lines hydraulically connected to hydraulic control valve 156. In this embodiment hydraulic control valve 156 and electrohydraulic pilot valve 160 are separate components, but in alternative embodiments the two valves may be integrated into a single valve assembly or manifold. In this embodiment, the hydraulic source is hydraulic pump 158. In alternative embodiments, a pressure reducing valve may be used to reduce the pressure of pressurized hydraulic fluid provided by hydraulic pump 158 to a set pressure, for example 600 pounds per square inch, for usage by electrohydraulic pilot valve 160. In the embodiment illustrated in FIG. 2, individual valves within electrohydraulic pilot valve 160 reduce the pressure from the received hydraulic fluid via solenoid-actuated spools which may drain hydraulic fluid to a hydraulic reservoir. In this embodiment, controller 138 actuates these solenoids by sending a specific current to each (e.g., 600 mA). In this way, controller 138 may actuate blade 142 by issuing electrical commands signals to electrohydraulic pilot valve 160, which in turn provides hydraulic signals (pilots) to hydraulic control valve 156, which shift spools to direct hydraulic flow from hydraulic pump 158 to actuate lift cylinders 150, tilt cylinder 152, and angle cylinders 154. In this embodiment, controller 138 is in direct communication with electrohydraulic pilot valve 160 via electrical signals sent through a wire harness and is indirectly in communication with hydraulic control valve 156 via electrohydraulic pilot valve 160.

Controller 138, which may be referred to as a vehicle control unit (VCU), is in communication with a number of components on work vehicle 100, including hydraulic components such as electrohydraulic pilot valve 160, electrical components such as operator inputs within operator station 136, sensor 144, sensor 149, and other components. Controller 138 is electrically connected to these other components by a wiring harness such that messages, commands, and electrical power may be transmitted between controller 138 and the remainder of work vehicle 100. Controller 138 may be connected to some of these sensors or other controllers, such as an engine control unit (ECU), through a controller area network (CAN). Controller 138 may then send and receive messages over the CAN to communicate with other components on the CAN.

In alternative embodiments, controller 138 may send a command to actuate blade 142 in a number of different manners. As one example, controller 138 may be in communication with a valve controller via a CAN and may send command signals to the valve controller in the form of CAN messages. The valve controller may receive these messages from controller 138 and send current to specific solenoids within electrohydraulic pilot valve 160 based on those messages. As another example, controller 138 may send a command to actuate blade 142 by sending a command to actuate an input in operator station 136. For example, an operator may use a joystick to issue commands to actuate blade 142, and the joystick may generate hydraulic pressure signals, pilots, which are communicated to hydraulic control valve 156 to cause the actuation of blade 142. In such a configuration, controller 138 may be in communication with electrical devices (e.g., solenoids, motors) which may actuate a joystick in operator station 136. In this way, controller 138 may actuate blade 142 by sending commands to actuate these electrical devices instead of communicating signals to electrohydraulic pilot valve 160.

Figure 3:
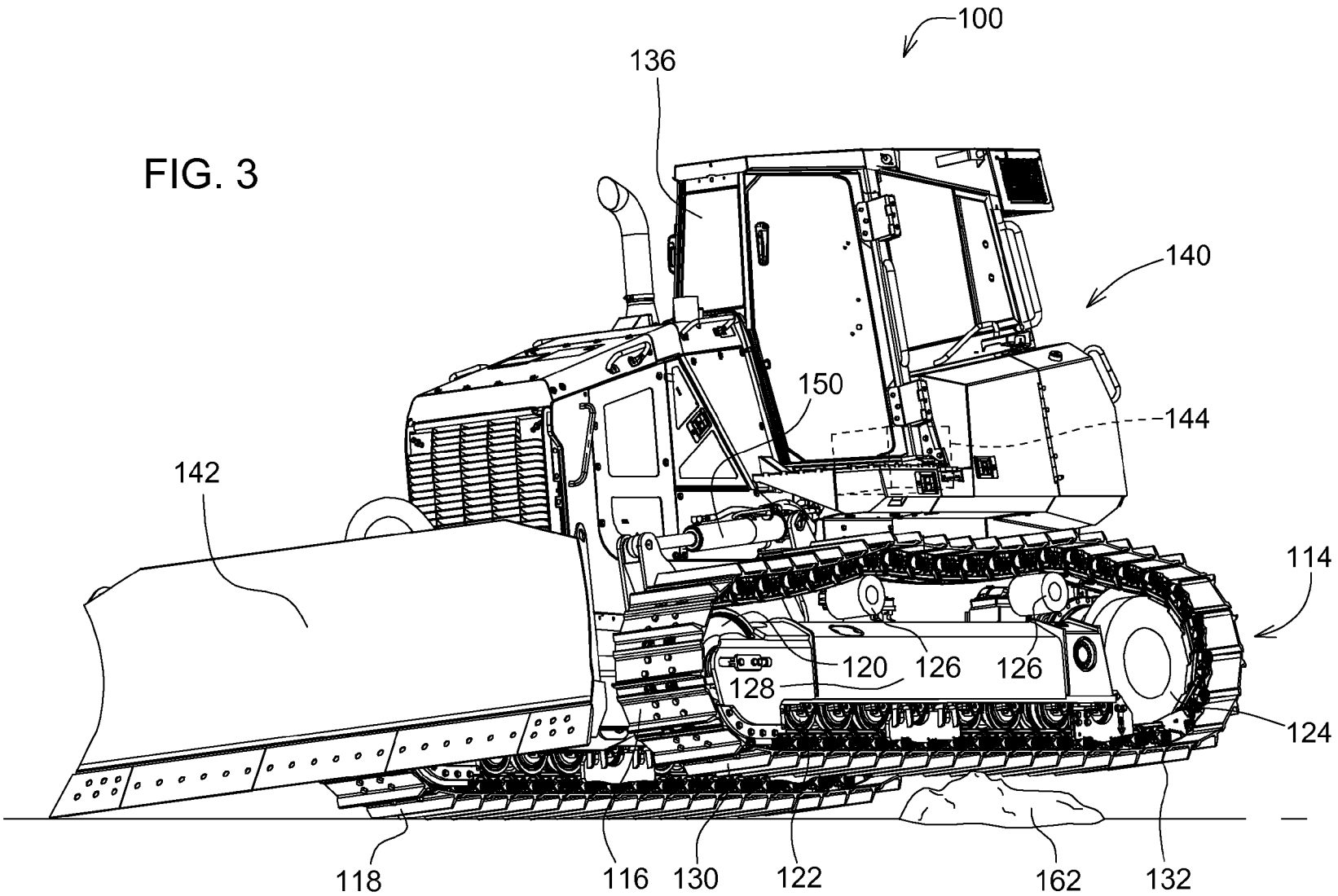
FIG. 3 is a perspective view of the crawler dozer encountering a ground feature on one side of the vehicle.

FIG. 3 is a perspective view of work vehicle 100 as work vehicle 100 drives over ground feature 162, which in this example is a ground feature at a higher elevation than the surrounding ground surface (e.g., an upward ground feature). As work vehicle 100 drives over ground feature 162, left track 116 engages ground feature 162 while right track 118 does not. This causes work chassis 140 to tilt or roll, as left track 116 rises over ground feature 162 and right track 118 remains at the same height. This tilting or rolling motion for chassis 140 is transmitted to blade 142 via linkage 146, and may cause blade 142 to tilt right (i.e., the left side of blade 142 will rise relative to the right side, or blade 142 will rotate clockwise when viewed from operator station 136). Sensor 144 will measure and provide a signal indicative of the angular velocity of chassis 140 in the direction of roll 104 (i.e., a chassis roll signal), and sensor 149 will measure and provide a signal indicative of the angular velocity of blade 142 in the direction of roll 104 (i.e., a blade roll signal). Sensor 144 will also measure and provide a signal indicative of the orientation or angular position of chassis 140 relative to the direction of gravity (i.e., a chassis tilt signal) and sensor 149 will also measure and provide a signal indicative of the orientation or angular position of blade 142 relative to the direction of gravity (i.e., a blade tilt signal). Controller 138 may receive these signals. As one example, before encountering ground feature 162, controller 138 may receive a chassis tilt signal and a blade tilt signal indicative of an angle of 3 degrees and a chassis roll signal and blade roll signal indicative of a roll rate of 0 degrees per second. As work vehicle 100 begins climbing ground feature 162, controller 138 may receive a chassis tilt signal indicative of an angle of 5 degrees, a blade tilt signal indicative of an angle of 4.5 degrees, a chassis roll signal indicative of a roll rate of 10 degrees per second, and a blade roll signal indicative of a roll rate of 9 degrees per second. When left track 116 crests ground feature 162, controller 138 may receive a chassis tilt signal and blade tilt signal indicative of an angle of 7 degrees and a chassis roll signal and blade roll signal indicative of a roll rate of 0 degrees per second.

During the process of work vehicle 100 driving over ground feature 162, blade 142 will tilt relative to the ground surface as it tilts with chassis 140. If the operator of work vehicle 100 fails to correct for ground feature 162 by commanding blade 142 to tilt in a manner that counteracts the effect of ground feature 162 on the tilt of blade 142, work vehicle 100 will create variations on the ground surface instead of a smooth surface, such as a hill and a valley. As work vehicle 100 drives over these newly created hills and valleys will cause further tilting of chassis 140, and blade 142 will once again be tilted and create further variations on the ground surface. This series of hills and valleys may be referred to as a "washboard" pattern or a "wavy" pattern.

While this is occurring, sensor 144 and sensor 149 send tilt and roll signals indicative of the tilt angle and roll rate of chassis 140 and blade 142, respectively. Controller 138 may also receive signals from controls in operator station 138 which the operator may use to issue commands, for example a command to tilt blade 142. If controller 138 does not sense a command from the operator to tilt blade 142, but receives a tilt and/or roll signal from sensor 144 or sensor 149 indicating that chassis 140 or blade 142 is tilting, controller 138 may issue a command to electrohydraulic pilot valve 160 to tilt blade 142 to counteract the effect of this tilt. In this manner, controller 138 may attempt to mitigate or attenuate the effect of unintended tilting of chassis 140 and thereby create a smoother ground surface, as further described with regard to FIG. 4.

In this embodiment, each of the chassis tilt signal, chassis roll signal, blade tilt signal, and blade roll signal may indicate a value which indicates both the direction and magnitude of its value. For example, for the tilt signals, values in one half of the range may indicate a magnitude of a clockwise tilt while values in the other half of the range indicating a magnitude of counterclockwise tilt. These signals may be encoded as CAN messages, voltages, or currents, to name but three possible examples, which may be received by controller 138.

In this embodiment, each of sensor 144 and sensor 149 comprise three accelerometers, each measuring linear acceleration in one of three perpendicular directions, and three gyroscopes, each measuring angular velocity in one of three perpendicular directions. In this way, sensor 144 and sensor 149 may each directly measure the linear acceleration or angular velocity in any direction, including the directions of longitude 102, latitude 106, vertical 110, roll 104, pitch 108, and yaw 112. The linear acceleration of each accelerometer may be filtered to remove short term accelerations or otherwise analyzed to determine the direction of gravity, which exerts a constant acceleration of approximately 9.81 meters per square second on sensor 144 and sensor 149. The measurements from the accelerometers and gyroscopes of sensor 144 and sensor 149 may be combined or analyzed together to improve the accuracy and/or reduce the latency with which the direction of gravity may be determined. For example, the accelerometers may measure the direction of gravity with high accuracy over a period of time sufficient to remove the effects of short-term accelerations, while the gyroscopes may measure changes to the direction of gravity very quickly but be subject to drift if these changes are integrated to determine the direction and error is allowed to accumulate.

The ability of sensor 144 and sensor 149 to provide both a tilt signal and a roll signal may allow controller 138 to better determine appropriate commands to actuate blade 142. By examining just a tilt signal from sensor 149, controller 138 may be able to maintain blade 142 near a target tilt angle with a relatively high degree of accuracy when work vehicle 100 is operating on a smooth surface. However, when work vehicle 100 is operating on rough terrain and tilting as it encounters ground features that are asymmetric in the direction of latitude 106, the addition of a roll signal from sensor 149 may allow controller 138 to keep blade 142 nearer the target tilt angle. The roll signal from sensor 149 may provide an earlier indication that blade 142 is moving away from the target tilt angle and thereby allow controller 138 to more rapidly respond with a command to actuate blade 142 to keep it near the target tilt angle. Alternative embodiments may determine a derivative of a tilt signal or other signal indicative of the orientation or position of blade 142 in an effort to gain an earlier indication that blade 142 is moving away from the target tilt angle, but such methods may introduce or compound error in the signal and thereby reduce the accuracy with which controller 138 may keep blade 142 near the target tilt angle.

Figure 4:
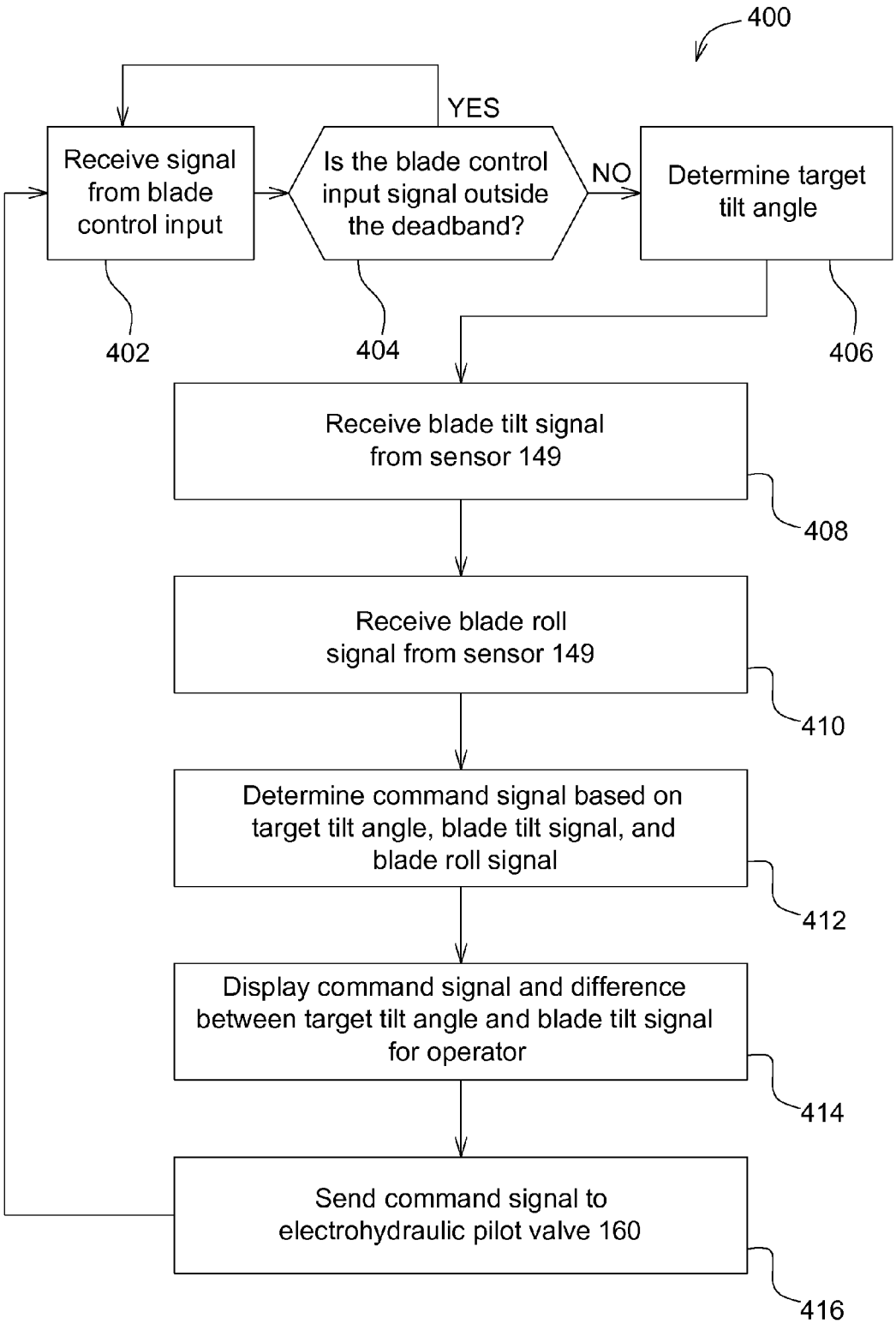
FIG. 4 is a flowchart of a method of tilting a blade of the crawler dozer to create a smooth surface.

FIG. 4 is a flowchart of control system 400 for actuating blade 142 of work vehicle 100 to create a level ground surface. Control system 400 is implemented on controller 138 of work vehicle 100, and is initiated at the start of work vehicle 100. In alternative embodiments, control system 400 may be initiated by the actuation of an operator control in operator station 136, such as a button or a selection on an interactive display. In step 402, controller 138 receives a signal from a blade control input in operator station 136, such as a joystick that the operator may actuate to issue a blade tilt command. In step 404, controller 138 determines whether the blade control input signal is outside of a deadband by determining whether the signal indicates a command (i.e., blade raise, tilt, or angle) above a threshold. This deadband may be used to avoid unintentional movement of the joystick near it neutral position, which may occur with vibration or machine movement, from being interpreted as a command to actuate blade 142. The size of the deadband, and the corresponding threshold before a command is interpreted as an actual command, may be adjusted and may differ from work vehicle to work vehicle. If controller 138 determines that the blade control input signal is outside of the deadband, controller 138 performs step 402. This loop between step 402 and step 404 effectively suspends control system 400 until the blade control input signal indicates that the operator is not issuing a command.

If the blade control input signal is in the deadband, which indicates that the operator is not issuing a command, controller 138 may perform step 406 next. In step 406, controller 138 determine the target tilt angle of blade 142. In this embodiment, controller 138 uses the tilt angle of blade 142 after the most recent tilt command of the operator as the target tilt angle. In this way, control system 400 may maintain blade 142 at the tilt angle it was last commanded to by the operator. In alternative embodiments, the target tilt angle may be set by the operator directly, such as through a switch which sends a command to set the target tilt angle to the current tilt angle of the blade when actuated, through increment or decrement buttons which may modify the target tilt angle when actuated, or through an interactive display in which the operator may directly input the target tilt angle. In other alternative embodiments, the target tilt angle may be set based on a signal received from a satellite-based navigation system (e.g., a Global Navigation Satellite System such as GPS, GLONASS, Compass, or Galileo) or a local positioning system, or a combination thereof. For example, a site plan may specify particular grades for different areas of the site and the location of work vehicle 100 may be determined based on the signal received from the navigation or positioning system and used to determine the appropriate target tilt angle from the site plan.

In step 408, controller 138 receives the blade tilt signal from sensor 149. As an example, controller 138 may receive a CAN message transmitted from sensor 149 to controller 138 via a wire harness. Controller 138 may be programmed to interpret the CAN message to read a value from 1 to 100, where 1 indicates a blade tilt angle of −15 degrees (i.e., 15 degree counterclockwise tilt when viewed from operator station 136) and 100 indicates a blade tilt angle of +15 degrees with intermediate blade tilt angles represented by intermediate values 2-99.

In step 410, controller 138 receives the blade roll signal from sensor 149. As an example, controller 138 may receive a CAN message transmitted from sensor 149 to controller 138 via a wire harness. Controller 138 may be programmed to interpret the CAN message to read a value from 1 to 100, where 1 indicates a blade roll rate of −20 degrees per second (i.e., a tilt rate of 20 degrees per second counterclockwise when viewed from operator station 136) and 100 indicates a blade roll angle of +20 degrees per second with intermediate blade roll rates represented by intermediate values 2-99.

In step 412, controller 138 determines a command signal based on the target tilt angle determined in step 406, the blade tilt signal received in step 408, and the blade roll signal received in step 410. In the embodiment illustrated in FIG. 4, controller 138 determines the command signal by applying a first gain to the difference between the target tilt angle and the blade tilt signal, applying a second gain to the blade roll signal, and combining the two results. For example, the first gain may be 5, the second gain may be −4, and the command signal may be indicative of a percent of maximum flow for tilt cylinder 152. In this example, if the target tilt angle is −2 degrees, the blade tilt signal indicates a blade tilt of −4 degrees, and the blade roll signal indicates a roll rate of −3 degrees per second, the command signal will be 22, or 22% of the maximum flow of tilt cylinder 152 in the retraction direction to tilt blade 142 toward the target tilt angle of −2 degrees. In an alternative embodiment, the command signal may be determined with a two-axis lookup table which utilizes two values (the difference between the target tilt angle and the blade tilt signal; the blade roll signal) to return the command signal. Such a two-axis lookup table may be programmed to achieve the desired behavior for control system 400. In other alternative embodiments, controller 138 may determine the command signal by a different method, including through the use of multiple lookup tables, equations, gains which are dependent on other factors, or PID (proportional-integrative-derivative) controllers, to name just a few possibilities. While the determination of the command signal in step 412 is based on the target tilt angle, blade tilt signal, and blade roll signal, other factors may also be used in the determination (e.g., speed of work vehicle 100, soil type or condition, steering command or actual steering rate for work vehicle 100).

In step 414, controller 138 may optionally utilize a means for displaying the command signal and the difference between the target tilt angle and the blade tilt signal for the operator. Such means may include a display which may receive a signal from controller 138 and display the two values, a speaker which may receive a signal from controller 138 and audibly describe the two values, or a light or series of lights which may receive a signal from controller 138 and illuminate to communicate the two values.

In step 416, the command signal determined in step 412 is sent by controller 138 to electrohydraulic pilot valve 160. This command signal may be in the form of a CAN message to another controller which directly controls electrohydraulic pilot valve 160 or may be a current carried by a wire harness directly to a solenoid in electrohydraulic pilot valve 160. This command signal may be used to change the pressure of one or more pilots from electrohydraulic pilot valve 160 to hydraulic control valve 156, and thereby change the metering of hydraulic fluid to a hydraulic function such as tilt cylinder 152 to tilt blade 142.

In alternative embodiments, control system 400 may be modified so as to suspend its operation while work vehicle 100 is turning. This modification may involve the addition of a step between step 404 and step 406, in which controller 138 determines whether work vehicle 100 is turning (i.e., changing its heading or rotating in the direction of yaw 112) greater than a minimum threshold. If it is, controller 138 may revert to step 402. If it does not, controller 138 may proceed to step 406. This modification to control system 400 may be beneficial if the design of sensor 149 is such that rotation of work vehicle 100 in the direction of yaw 112 interferes with the measurement of blade tilt or blade roll. In such cases, control system 400 may be suspended until work vehicle 100 is done turning, or a time period after that if sensor 149 needs further time to settle and accurately measure blade tilt and blade roll, to prevent control system 400 from operating based on inaccurate signals.

Figure 5:
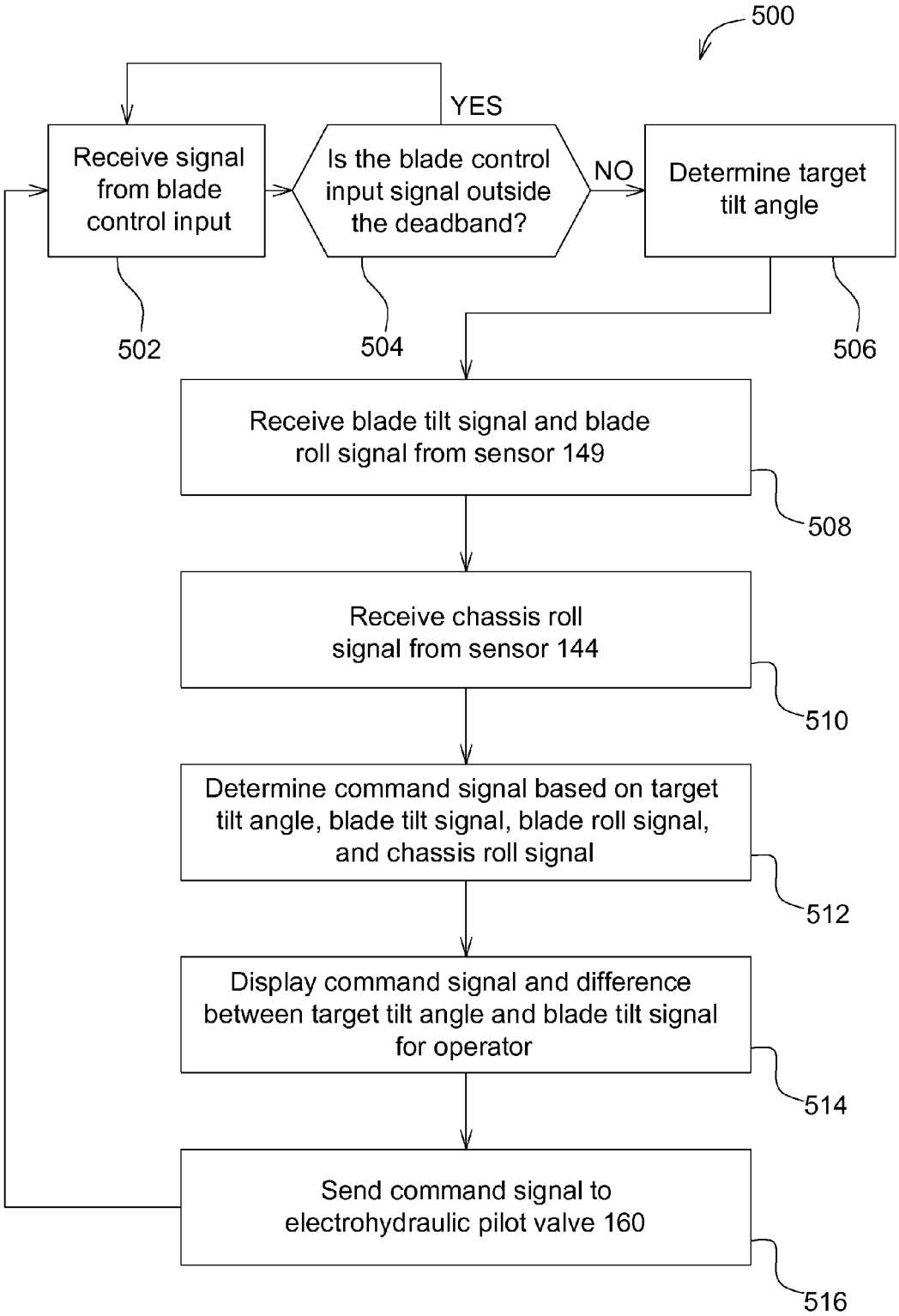
FIG. 5 is a flowchart of another method of tilting the blade of the crawler dozer to create a smooth surface.

FIG. 5 is a flowchart of control system 500 for actuating blade 142 of vehicle 100. Control system 500, unlike control system 400, utilizes signals from sensor 144 to determine the command signal.

In step 502, controller 138 receives a signal from a blade control input in operator station 136. In step 504, controller 138 determines whether the blade control input signal is outside of a deadband. If controller 138 determines that the blade control input signal is outside of the deadband, controller 138 performs step 502. This loop between step 502 and step 504 effectively suspends control system 500 until the blade control input signal indicates that the operator is not issuing a command. In alternative embodiments, control system 500 may be adjusted so that it also operates when the operator is issuing a command. In such embodiments, control system 500 may sum the operator commands and its command signal to provide a summed command signal, or it may weight or adjust the operator commands and its command signal to achieve a modified command signal that is not simply the sum of the operator command and the determined command signal.

If the blade control input signal is in the deadband, which indicates that the operator is not issuing a command, controller 138 may perform step 506 next. In step 506, controller 138 determine the target tilt angle of blade 142. In this embodiment, controller 138 uses the tilt angle of blade 142 specified by a site plan for the current location work vehicle 100.

In step 508, controller 138 receives the blade tilt signal and blade roll signal from sensor 149. As an example, controller 138 may receive a CAN message transmitted from sensor 149 to controller 138 via a wire harness. Controller 138 may be programmed to interpret the CAN message to read two values, one of which indicates a blade tilt angle and the other of which indicates the blade roll rate.

In step 510, controller 138 receives the chassis roll signal from sensor 144. As an example, controller 138 may receive a CAN message transmitted from sensor 144 to controller 138 via a wire harness. Controller 138 may be programmed to interpret the CAN message to read a value which indicates a chassis roll rate (i.e., the angular velocity of chassis 140 in the direction of roll 104). In alternative embodiments, controller 138 may also receive the chassis tilt signal (i.e., the angle of chassis 140 relative to the direction of gravity) from sensor 144.

In step 512, controller 138 determines a command signal based on the target tilt angle determined in step 506, the blade tilt signal received in step 508, the blade roll signal received in step 508, and the chassis roll signal received in step 510. In the embodiment illustrated in FIG. 5, controller 138 determines the command signal by applying a first gain to the difference between the target tilt angle and the blade tilt signal and a second gain to the greater absolute value of the blade roll signal and chassis roll signal. For example, the first gain may be 5, the second gain may be −4, and the command signal may be indicative of a percent of maximum flow for tilt cylinder 152. In this example, if the target tilt angle is −2 degrees, the blade tilt signal indicates a blade tilt of −4 degrees, the blade roll signal indicates a roll rate of −2 degrees per second, and the chassis roll signal is −3 degrees per second, the command signal will be 22, or 22% of the maximum flow of tilt cylinder 152 in the retraction direction to tilt blade 142 toward the target tilt angle of −2 degrees. In an alternative embodiment, the command signal may be determined with a three-axis lookup table which utilizes three values (the difference between the target tilt angle and the blade tilt signal; the blade roll signal; the chassis roll signal) to return the command signal. Such a three-axis lookup table may be programmed to achieve the desired behavior for control system 500. In other alternative embodiments, controller 138 may determine the command signal by a different method, including through the use of multiple lookup tables, equations, gains which are dependent on other factors, or PID (proportional-integrative-derivative) controllers, to name just a few possibilities. While the determination of the command signal in step 512 is based on the target tilt angle, blade tilt signal, blade roll signal, and chassis roll signal, other factors may also be used in the determination (e.g., chassis tilt signal, speed of work vehicle 100, soil type or condition, steering command or actual steering rate for work vehicle 100). For example, controller 138 may utilize a chassis tilt signal from sensor 144 to determine the command signal by applying a gain to the signal and summing it with the other factors or by adjusting the magnitude of the chassis roll signal based on the chassis tilt signal, to name but two possibilities.

In step 514, controller 138 may optionally utilize a means for displaying the command signal and the difference between the target tilt angle and the blade tilt signal for the operator. Such means may include a display which may receive a signal from controller 138 and display the two values, a speaker which may receive a signal from controller 138 and audibly describe the two values, or a light or series of lights which may receive a signal from controller 138 and illuminate to communicate the two values.

In step 516, the command signal determined in step 512 is sent by controller 138 to electrohydraulic pilot valve 160. This command signal may be in the form of a CAN message to another controller which directly controls electrohydraulic pilot valve 160 or may be a current carried by a wire harness directly to a solenoid in electrohydraulic pilot valve 160. This command signal may be used to change the pressure of one or more pilots from electrohydraulic pilot valve 160 to hydraulic control valve 156, and thereby change the metering of hydraulic fluid to a hydraulic function such as tilt cylinder 152 to tilt blade 142.

While the disclosure has been illustrated and described in detail in the drawings and foregoing description, such illustration and description is not restrictive in character, it being understood that illustrative embodiment(s) have been shown and described and that all changes and modifications that come within the spirit of the disclosure are desired to be protected. Alternative embodiments of the present disclosure may not include all of the features described yet still benefit from at least some of the advantages of such features. Those of ordinary skill in the art may devise their own implementations that incorporate one or more of the features of the present disclosure and fall within the spirit and scope of the appended claims.

What is claimed is:

1. A work vehicle comprising:

a chassis;

a ground-engaging blade movably connected to the chassis via a linkage configured to allow the blade to be tilted relative to the chassis;

a first sensor assembly connected to the blade at a fixed relative position to the blade, the first sensor assembly configured to provide a blade tilt signal indicative of an angle of the blade in a roll direction, the sensor assembly configured to provide a blade roll signal indicative of a rotational velocity of the blade in the roll direction;

a second sensor assembly connected to the chassis at a fixed relative position to the chassis, the second sensor assembly configured to provide a chassis roll signal indicative of a rotational velocity of the chassis in the roll direction; and a controller configured to:

determine a target tilt angle;

receive the blade tilt signal;

receive the blade roll signal; and send a command to tilt the blade toward the target tilt angle, the command based on the blade tilt signal, the blade roll signal, the chassis roll signal, and the target tilt angle.

2. The work vehicle of claim 1, wherein the controller is further configured to receive a blade tilt command from an operator input and determine the target tilt angle based on the blade tilt signal upon termination of the most recent blade tilt command.

3. The work vehicle of claim 1, wherein the controller is further configured to determine the target tilt angle based on a signal from a satellite-based navigation system or a local positioning system.

4. The work vehicle of claim 1, wherein the controller is further configured to determine the command signal based on a first gain applied to a difference between the blade tilt signal and the target tilt angle and a second gain applied to the blade roll signal.

5. The work vehicle of claim 1, further comprising a means for communicating a difference between the blade tilt signal and the target tilt angle to an operator.

* * * * *